US011278917B2

(12) United States Patent
Ou et al.

(10) Patent No.: US 11,278,917 B2
(45) Date of Patent: Mar. 22, 2022

(54) INDUCTIVE ELECTROSTATIC ATOMIZATION NOZZLE

(71) Applicant: Jiangsu University, Jiangsu (CN)

(72) Inventors: Mingxiong Ou, Jiangsu (CN); Weidong Jia, Jiangsu (CN); Xuejun Yang, Jiangsu (CN); Xiang Dong, Jiangsu (CN)

(73) Assignee: Jiangsu University, Jiangsu (CN)

( * ) Notice: Subject to any disclaimer, the term of this patent is extended or adjusted under 35 U.S.C. 154(b) by 0 days.

(21) Appl. No.: 17/289,715

(22) PCT Filed: May 27, 2020

(86) PCT No.: PCT/CN2020/092487

§ 371 (c)(1),
(2) Date: Apr. 28, 2021

(87) PCT Pub. No.: WO2021/012778

PCT Pub. Date: Jan. 28, 2021

(65) Prior Publication Data

US 2022/0001400 A1 Jan. 6, 2022

(30) Foreign Application Priority Data

Jul. 24, 2019 (CN) ..... 201910669205.1

(51) Int. Cl.
*B05B 7/08* (2006.01)
*B05B 5/053* (2006.01)
*B05B 1/06* (2006.01)

(52) U.S. Cl.
CPC ..... *B05B 1/06* (2013.01); *B05B 5/0533* (2013.01); *B05B 7/0815* (2013.01)

(58) Field of Classification Search
CPC .. B05B 1/06; B05B 5/025; B05B 5/03; B05B 5/043; B05B 5/053; B05B 5/0533;
(Continued)

(56) References Cited

U.S. PATENT DOCUMENTS 3,915,380 A * 10/1975 Luderer ..... B05B 5/053 239/708
4,106,697 A * 8/1978 Sickles ..... B05B 5/043 239/291

(Continued)

FOREIGN PATENT DOCUMENTS

CN 201510953 6/2010
CN 204523314 8/2015

(Continued)

OTHER PUBLICATIONS

"International Search Report (Form PCT/ISA/210) of PCT/CN2020/092487," dated Aug. 26, 2020, with English translation thereof, pp. 1-5.

*Primary Examiner* — Jason J Boeckmann
(74) *Attorney, Agent, or Firm* — JCIP Global Inc.

(57) ABSTRACT

An inductive electrostatic atomization nozzle includes a nozzle body. The nozzle body has an internal gas flow channel and a liquid flow channel surrounding the internal gas flow channel. An electrode ring is arranged around the liquid flow channel at an inlet of the liquid flow channel. In the inductive electrostatic atomization nozzle, the electrode ring is arranged at the inlet of the liquid flow channel, which ensures that the electrode ring is located far away from the outlet of the inductive electrostatic atomization nozzle.

4 Claims, 2 Drawing Sheets

(58) Field of Classification Search
CPC ..... B05B 7/04; B05B 7/0416; B05B 7/062; B05B 7/08; B05B 7/0815
See application file for complete search history.

(56) References Cited

U.S. PATENT DOCUMENTS 4,347,984 A * 9/1982 Sickles ..... B05B 5/043 239/291
5,093,602 A * 3/1992 Kelly ..... B05B 5/025 239/3
5,188,290 A * 2/1993 Gebauer ..... B05B 5/03 239/132

FOREIGN PATENT DOCUMENTS

| | | |
|---|---|---|
| CN | 205684217 | 11/2016 |
| CN | 106861960 | 6/2017 |
| CN | 208131312 | 11/2018 |
| CN | 208661447 | 3/2019 |
| CN | 110180693 | 10/2019 |
| DE | 102016207552 | 11/2017 |

* cited by examiner

INDUCTIVE ELECTROSTATIC ATOMIZATION NOZZLE

CROSS-REFERENCE TO RELATED APPLICATION

This application is a 371 of international application of PCT application serial no. PCT/CN2020/092487, filed on May 27, 2020, which claims the priority benefit of China application no. 201910669205.1, filed on Jul. 24, 2019. The entirety of each of the above mentioned patent applications is hereby incorporated by reference herein and made a part of this specification.

BACKGROUND

Technical Field

The present invention relates to a nozzle, and in particular, to an inductive electrostatic atomization nozzle.

Description of Related Art

Electrostatic atomization is an advanced spraying technology widely used in fields such as agricultural plant protection pesticide spraying, industrial spray combustion, and drying. Especially in the technical field of agricultural plant protection pesticide spraying, an inductive electrostatic atomization nozzle integrating an air-assisted atomization technology and an electrostatic induction charging technology is a plant protection spray component with pesticide-saving, water-saving, efficient atomization, and anti-drift performances.

At present, the spray patterns of existing pneumatically assisted inductive electrostatic atomization nozzle products are all solid-cone spray nozzles. During the spraying process of the nozzle, a high-pressure liquid flows through a central hole of the nozzle to an outlet, and a high-pressure gas is jetted out at a high speed from the periphery of the central hole of the nozzle to form a gas jet flow. The jet flow helps to enhance the atomization and air-liquid conveying effects. Meanwhile, the high-pressure liquid is atomized and dispersed in a central area of the jet flow and produces a solid-cone droplet group. In addition, due to the electrostatic induction phenomenon caused by a high-voltage electrode device mounted at the outlet of the nozzle, different charges are generated on the liquid surface at the outlet of the nozzle, and liquid droplets with a certain quantity of charges are produced. The liquid droplets are entrained and pushed by the jet flow to move toward the surfaces of crops or other targets, and are finally adsorbed and deposited on the front and back surfaces of the leaves of the crops or other targets. In general, the existing pneumatically assisted inductive electrostatic atomization nozzles feature small flow, fine droplets, and good adsorption performance of the droplets on leaf surfaces. They can effectively improve the adsorption effect of pesticide droplets on the surfaces of crop leaves, especially the back surfaces of the leaves, effectively kill the pests on the back surfaces of the leaves, and improve the pest control effect of pesticides.

Although the existing pneumatically assisted inductive electrostatic atomization nozzles have the above advantages, the following two problems still exist.

(1) The spray patterns of the existing pneumatically assisted inductive electrostatic atomization nozzle products are mostly solid-cone nozzle, the high-pressure liquid flows out through the central hole of the nozzle, and the spray cone angle is small and is generally in a range of 15°-30°. Therefore, they can hardly meet the requirements of wide-width plant protection spray machines such as boom sprayers, and are mostly used in single nozzle spraying applications such as hand-held orchard sprayers.

(2) The high-voltage electrode device (such as electrode ring or electrode plate) of the existing inductive electrostatic atomization nozzle is arranged near the outlet of the nozzle, and is generally mounted on the outlet periphery of the central hole of the nozzle. During the spraying process, since the charges on the high-voltage electrode device and the charges carried by the liquid droplets are opposite charges, a part of the liquid droplets sprayed from the nozzle are directly adsorbed to the surface of the high-voltage electrode device, and a part of the liquid droplets are adsorbed on the outer surface of the nozzle body after retracing from outside the nozzle body under the attraction of the charges (exerted by an external electric field) of the high-voltage electrode device. The phenomenon in which charged droplets are adsorbed on the surface of the high-voltage electrode device and the outer surface of the nozzle body is called droplet adsorption, which can easily cause problems such as unstable charging effect, liquid leakage, and high-voltage discharge in the electrostatic spray system, also cause electrical safety hazards, and endanger the safety of operators. At present, a special coating structure such as an insulating layer is designed on the exterior of the electrode device to enhance the insulation effect of the high-voltage electrode device in some Chinese patents. However, the coating structure such as the insulating layer has a tiny impact on the external electric field strength of the electrode, and the droplet adsorption phenomenon is not alleviated.

SUMMARY

An objective of the present invention is to provide an inductive electrostatic atomization nozzle.

The present invention provides an inductive electrostatic atomization nozzle, comprising a nozzle body. The nozzle body has an internal gas flow channel and a liquid flow channel surrounding the internal gas flow channel. An electrode ring is arranged around the liquid flow channel at an inlet of the liquid flow channel.

Preferably, the inductive electrostatic atomization nozzle further comprises a tapered sleeve head. The tapered sleeve head comprises an annular pipe and an external tapered pipe that are integrally arranged, the annular pipe is in threaded connection to a side wall of the nozzle body. A bottom portion of the annular pipe is in communication with the internal gas flow channel.

Preferably, the nozzle body comprises a main nozzle and a nozzle head in threaded connection to the main nozzle. An insertion head is provided at a front end of the main nozzle, and the insertion head is inserted into the nozzle head and forms an annular gap with a side wall of the nozzle head. The liquid flow channel is in communication with the annular gap. A tapered annular portion extending from the insertion head to an outlet of the nozzle head is provided on an inner wall of the nozzle head.

Preferably, the internal gas flow channel has a buffer chamber and a diffuser pipe in communication with the buffer chamber. An outlet of the diffuser pipe is located on a free end surface of the insertion head.

Preferably, the inductive electrostatic atomization nozzle further comprises a closed sleeve. A placement chamber is provided at the inlet of the liquid flow channel at a bottom of the main nozzle, and the electrode ring is placed in the placement chamber. The closed sleeve is in threaded connection to the bottom of the main nozzle to fix the electrode ring. The closed sleeve is provided with an electrical connection through-hole for electrical connection to the electrode ring, a liquid through-hole for communication with the inlet of the liquid flow channel, and an internal through-hole for communication with an inlet of the internal gas flow channel.

Preferably, the main nozzle comprises a nozzle middle body and a nozzle rear body in threaded connection to the nozzle middle body. The insertion head is located at a front portion of the nozzle middle body. A seal ring around the buffer chamber is arranged on a joint surface between the nozzle middle body and the nozzle rear body.

Preferably, the electrode ring comprises a metal ring and a contact piece connected to the metal ring. A ratio of an axial length of the metal ring to an inner diameter of the metal ring is 1.5-3.

Preferably, a diffusion angle of the diffuser pipe is 10°-20°.

Preferably, a difference between an inner diameter and an outer diameter of the annular gap is 0.2 mm-1 mm.

The present invention has the following beneficial effects. In the inductive electrostatic atomization nozzle of the present invention, the electrode ring is arranged at the inlet of the liquid flow channel on a rear side, which ensures that the electrode ring is located far away from the outlet of the inductive electrostatic atomization nozzle, so that the electric field strength at the inductive electrostatic atomization nozzle is reduced, and the droplet adsorption phenomenon is avoided to a certain extent.

BRIEF DESCRIPTION OF THE DRAWINGS

The present invention is further described below with reference to the accompanying drawings and embodiments.

In the drawings.

Figure 1:
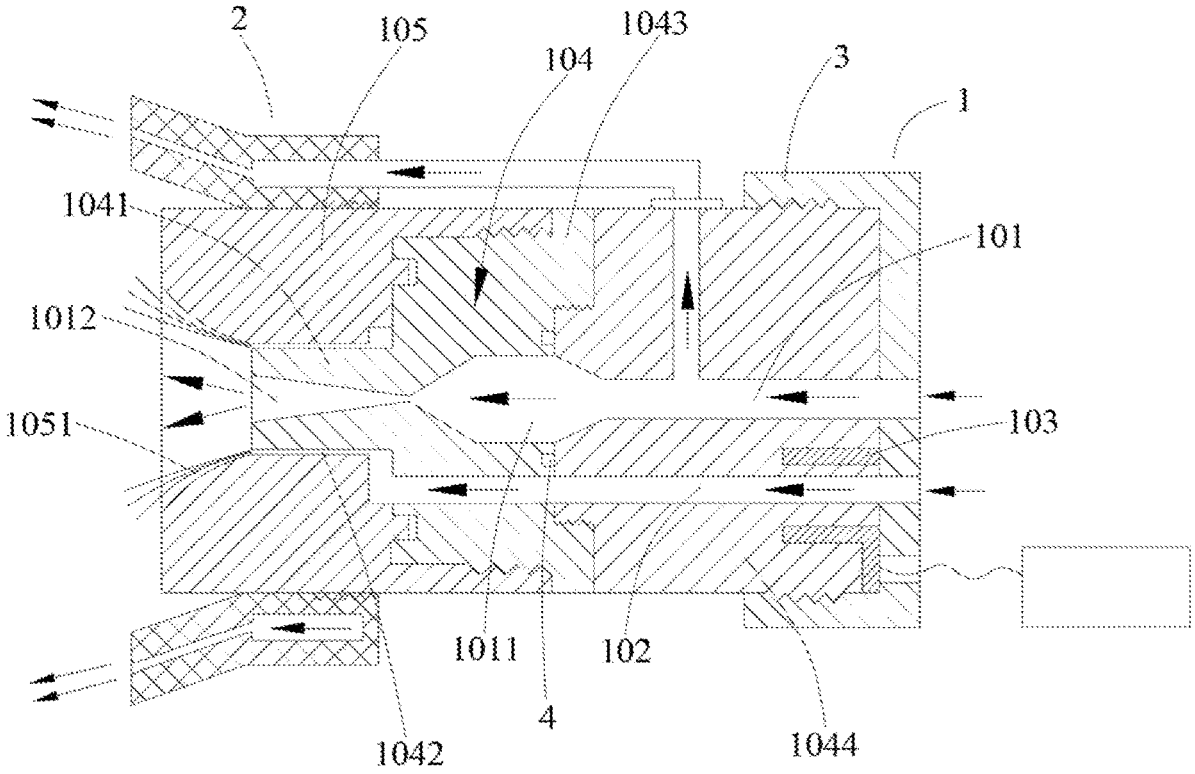
FIG. 1 is a schematic structural diagram of a preferred embodiment of an inductive electrostatic atomization nozzle according to the present invention.

nozzle body 1;

internal gas flow channel 101, buffer chamber 1011, diffuser pipe 1012;

liquid flow channel 102, electrode ring 103, metal ring 1031, contact piece 1032;

main nozzle 104, insertion head 1041, annular gap 1042, nozzle middle body 1043, nozzle rear body 1044;

nozzle head 105, tapered annular portion 1051;

tapered sleeve head 2, annular pipe 201, external tapered pipe 202;

closed sleeve 3, seal ring 4.

DESCRIPTION OF THE EMBODIMENTS

The present invention is further described in detail below with reference to the accompanying drawings. The accompanying drawings are simplified and illustrate the basic structure of the present invention in a schematic way, so they only show constitutions related to the present invention.

Figure 2:
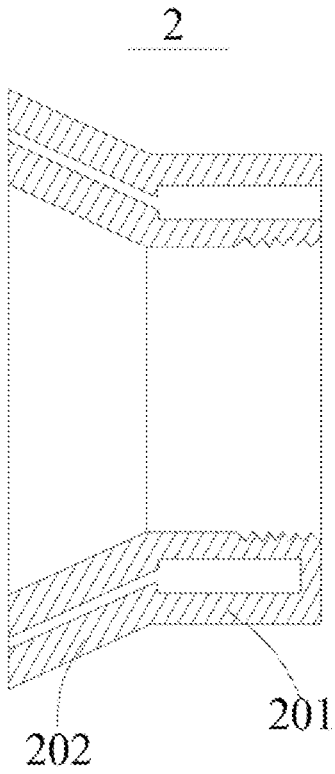
FIG. 2 is a schematic structural diagram of a preferred embodiment of a tapered sleeve head according to the present invention.
Figure 3:
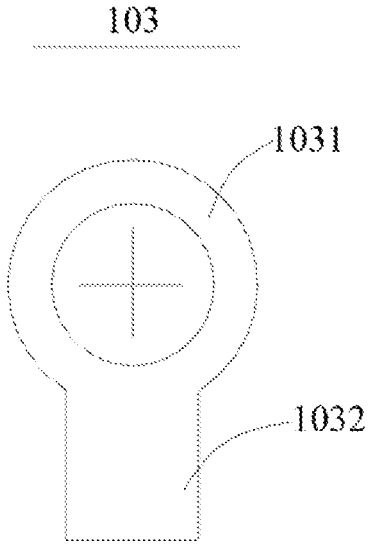
FIG. 3 is a schematic structural diagram of a preferred embodiment of an electrode ring according to the present invention.

As shown in FIG. 1 to FIG. 3, an inductive electrostatic atomization nozzle of the present invention includes a nozzle body 1. The nozzle body 1 has an internal gas flow channel 101 and a liquid flow channel 102 surrounding the internal gas flow channel 101.

An electrode ring 103 is arranged around the liquid flow channel 102 at an inlet of the liquid flow channel 102.

In the inductive electrostatic atomization nozzle, the electrode ring 103 is arranged at the inlet of the liquid flow channel 102 on a rear side, which ensures that the electrode ring 103 is located far away from the inductive electrostatic atomization nozzle, so that the electric field strength at the outlet of the inductive electrostatic atomization nozzle is reduced, and the droplet adsorption phenomenon is avoided to a certain extent.

In this embodiment, the following technical solution is adopted to further avoid the droplet adsorption phenomenon. The inductive electrostatic atomization nozzle further includes a tapered sleeve head 2. The tapered sleeve head 2 includes an annular pipe 201 and an external tapered pipe 202 that are integrally arranged, the annular pipe 201 is in threaded connection to a side wall of the nozzle body 1, and a bottom portion of the annular pipe 201 is in communication with the internal gas flow channel 101.

When a high-pressure gas is introduced into the internal gas flow channel 101, a stream of the high-pressure gas is jetted out from the internal gas flow channel 101, and another stream of the high-pressure gas is jetted out along the annular pipe 201 and the external tapered pipe 202, so that two jets of the high-pressure gas are formed. Meanwhile, a high-pressure liquid is fed into the liquid flow channel 102 and is atomized and jetted out by the two jets of the high-pressure gas in the nozzle body 1.

The annular pipe 201 and the external tapered pipe 202 are arranged to be in cooperation with the internal gas flow channel 101, so that the atomization intensity and jet intensity are increased, and further, in cooperation with the electrode ring 103 arranged on the rear side, the droplet adsorption phenomenon is well avoided.

In this embodiment, the nozzle body 1 includes a main nozzle 104 and a nozzle head 105 in threaded connection to the main nozzle 104. An insertion head 1041 is provided at a front end of the main nozzle 104, and the insertion head 1041 is inserted into the nozzle head 105 and forms an annular gap 1042 with a side wall of the nozzle head 105. The liquid flow channel 102 is in communication with the annular gap 1042. A tapered annular portion 1051 extending from the insertion head 1041 to an outlet of the nozzle head 105 is provided on an inner wall of the nozzle head 105.

When a liquid is fed into the liquid flow channel 102, the liquid is squeezed by the annular gap 1042 and is jetted out. The liquid flow is atomized and jetted out under the impacts from the high-pressure gas flowing through the internal gas flow channel 101 the external tapered pipe 202. Further, due to the high-pressure gas in the internal gas flow channel 101 and the external gas in the external tapered pipe 202, a spray cone angle is significantly enlarged, which ensures that the liquid can be dispersed in a larger area and the spraying effect is improved. The tapered annular portion 1051 is used for guiding the droplets and synchronously guiding the high-pressure gas in the internal gas flow channel 101, thereby gradually changing the dispersion direction of the droplets. Moreover, the tapered annular portion 1051 has an arc-shape side wall, and the dispersion direction (which is a tangential direction of the tapered annular portion 1051) gradually and continuously changes, which ensures that the dispersed droplets receive impacts from the external gas and thus the adsorption phenomenon is undoubtedly alleviated.

In this embodiment, the internal gas flow channel 101 has a buffer chamber 1011 and a diffuser pipe 1012 in communication with the buffer chamber 1011. An outlet of the diffuser pipe 1012 is located on a free end surface of the insertion head 1041. The buffer chamber 1011 is arranged to preliminarily buffer the gas fed into the internal gas flow channel 101. Then, the gas is dispersed in the diffuser pipe 1012. Further, a part of the gas is squeezed by the external tapered pipe 202 and is jetted out, exerting impacts on the liquid so as to atomize the liquid.

In this embodiment, the inductive electrostatic atomization nozzle further includes a closed sleeve 3. A placement chamber is provided at the inlet of the liquid flow channel 102 at a bottom of the main nozzle 104, and the electrode ring 103 is placed in the placement chamber. The closed sleeve 3 is in threaded connection to the bottom of the main nozzle 104 to fix the electrode ring 103. The closed sleeve 3 is provided with an electrical connection through-hole for electrical connection to the electrode ring 103, a liquid through-hole for communication with the inlet of the liquid flow channel 102, and an internal through-hole for communication with an inlet of the internal gas flow channel 101. The closed sleeve 3 is detachable.

In this embodiment, the main nozzle 104 includes a nozzle middle body 1043 and a nozzle rear body 1044 in threaded connection to the nozzle middle body 1043. The insertion head 1041 is located at a front portion of the nozzle middle body 1043. A seal ring 4 around the buffer chamber 1011 is arranged on a joint surface between the nozzle middle body 1043 and the nozzle rear body 1044. The nozzle middle body 1043 and the nozzle rear body 1044 are arranged for the purpose of detachability, and because they are detachable, leakage may easily occur in the internal gas flow channel 101. Therefore, the seal ring 4 is arranged to ensure a good sealing effect.

In this embodiment, the electrode ring 103 includes a metal ring 1031 and a contact piece 1032 connected to the metal ring 1031. A ratio of an axial length of the metal ring 1031 to an inner diameter of the metal ring 1031 is 1.5-3. If the axial length of the metal ring 1031 is short, its surface area is small, the quantity of charges on the surface is small, and the resulting electric field strength at a far end is relatively low. By increasing the axial length, the surface area and the quantity of charges on the surface are increased, and accordingly the electric field strength at the far end is increased. However, when the axial length reaches a certain value, the electric field strength at the far end is basically constant, and thus the above ratio is optimal.

In this embodiment, a diffusion angle of the diffuser pipe 1012 is 10°-20°. A difference between an inner diameter and an outer diameter of the annular gap 1042 is 0.2 mm-1 mm.

Generally, the existing nozzle solutions are derived from conventional electrostatic induction tests. Therefore, to ensure a significant electrostatic induction charging performance on the droplets, it is considered to arrange the electrode ring 103 closer to the outlet of the liquid flow channel 102, and stronger electrostatic induction performance is caused by a lower voltage, so that the electrostatic adsorption phenomenon still exists.

In this application, the electrode ring 103 is placed at the inlet of the liquid flow channel 102 which is far away from the outlet of the liquid flow channel 102, and the voltage is increased. Therefore, the adsorption effect is significantly reduced and the quantity of charges on the droplets is ensured.

However, the size of a nozzle is limited, as the cost of an oversized nozzle is largely increased and thus it is no longer competitive in the market. Therefore, the length of the nozzle is limited, so that the effect of only arranging the electrode ring 103 near the inlet of the liquid flow channel 102 has a limited effect, and thus it is necessary to increase the droplet jet intensity to further alleviate the adsorption phenomenon.

Enlightened by the preferred embodiments of the present invention and based on the above description, persons involved in the art can make various changes and modifications without departing from the scope of the technical idea of the present invention. The technical scope of the present invention is not limited to the content of the specification, and shall be determined according to the appended claims.

What is claimed is:

1. An inductive electrostatic atomization nozzle, comprising a nozzle body, wherein the nozzle body has an internal gas flow channel and a liquid flow channel surrounding the internal gas flow channel, wherein an electrode ring is arranged around the liquid flow channel at an inlet of the liquid flow channel;

the inductive electrostatic atomization nozzle further comprises a tapered sleeve head, wherein the tapered sleeve head comprises an annular pipe and an external tapered pipe that are integrally arranged, the annular pipe is in threaded connection to a side wall of the nozzle body;

a bottom portion of the annular pipe is in communication with the internal gas flow channel;

the nozzle body comprises a main nozzle and a nozzle head in threaded connection to the main nozzle;

an insertion head is provided at a front end of the main nozzle, and the insertion head is inserted into the nozzle head and forms an annular gap with a side wall of the nozzle head;

the liquid flow channel is in communication with the annular gap;

a tapered annular portion extending from the insertion head to an outlet of the nozzle head is provided on an inner wall of the nozzle head;

the internal gas flow channel has a buffer chamber and a diffuser pipe in communication with the buffer chamber, an outlet of the diffuser pipe is located on a free end surface of the insertion head;

the inductive electrostatic atomization nozzle further comprises a closed sleeve;

a placement chamber is provided at the inlet of the liquid flow channel at a bottom portion of the main nozzle, and the electrode ring is placed in the placement chamber;

the closed sleeve is in threaded connection to the bottom portion of the main nozzle to fix the electrode ring;

the closed sleeve is provided with an electrical connection through-hole for electrical connection to the electrode ring, a liquid through-hole for communication with the inlet of the liquid flow channel, and an internal through-hole for communication with an inlet of the internal gas flow channel;

the main nozzle comprises a nozzle middle body and a nozzle rear body in threaded connection to the nozzle middle body;

the insertion head is located at a front portion of the nozzle middle body; and a seal ring around the buffer chamber is arranged on a joint surface between the nozzle middle body and the nozzle rear body.

2. The inductive electrostatic atomization nozzle according to claim 1, wherein:

the electrode ring comprises a metal ring and a contact piece connected to the metal ring; and a ratio of an axial length of the metal ring to an inner diameter of the metal ring is 1.5-3.

3. The inductive electrostatic atomization nozzle according to claim 1, wherein:

a diffusion angle of the diffuser pipe is 10°-20°.

4. The inductive electrostatic atomization nozzle according to claim 1, wherein:

a difference between an inner diameter and an outer diameter of the annular gap is 0.2 mm-1 mm.

* * * * *